US007177589B1

(12) United States Patent
Lynch

(10) Patent No.: US 7,177,589 B1
(45) Date of Patent: Feb. 13, 2007

(54) SATELLITE ENTERTAINMENT RECEIVER SYSTEM

(76) Inventor: William H Lynch, 1672 Washington St., West Newton, MA (US) 02065

( * ) Notice: Subject to any disclaimer, the term of this patent is extended or adjusted under 35 U.S.C. 154(b) by 659 days.

(21) Appl. No.: 10/011,149

(22) Filed: Dec. 7, 2001

(51) Int. Cl.
*H04H 1/00* (2006.01)

(52) U.S. Cl. ..... 455/3.04; 455/90.1; 701/1

(58) Field of Classification Search ..... 455/3.02, 455/3.06, 12.1, 31.1, 54.1, 269, 154.1, 152.1, 455/297, 344–347, 95–100, 3.04, 90.1; 370/50, 370/73, 84, 95.1, 110.1; 700/31, 116
See application file for complete search history.

(56) References Cited

U.S. PATENT DOCUMENTS 3,947,882 A 3/1976 Lightner
5,418,654 A 5/1995 Scheffler
5,572,442 A 11/1996 Schulhof et al.
5,661,787 A 8/1997 Pocock
5,722,069 A 2/1998 Donner
5,734,589 A 3/1998 Kostreski et al.
5,857,156 A 1/1999 Anderson
5,914,941 A 6/1999 Janky
6,067,562 A 5/2000 Goldman
6,130,727 A 10/2000 Toyozumi
6,212,555 B1 4/2001 Brooks, Jr. et al.
6,282,491 B1 8/2001 Bochmann et al.
6,369,717 B1 * 4/2002 Damiani et al. ..... 340/815.4
6,526,335 B1 * 2/2003 Treyz et al. ..... 701/1
6,657,657 B1 * 12/2003 Sato ..... 348/207.2
6,718,319 B1 * 4/2004 Fisher et al. ..... 707/1

* cited by examiner

*Primary Examiner*—Curtis Kuntz
*Assistant Examiner*—Matthew C Sams
(74) *Attorney, Agent, or Firm*—Michael I. Kroll

(57) ABSTRACT

A satellite entertainment receiver system for receiving satellite broadcasts. The system includes a receiver for receiving the satellite broadcasts, a tuner for tuning the receiver to a satellite broadcast transmitted at a desired frequency, speakers for reproducing audio data within the satellite broadcast; a display screen for displaying information data within the satellite broadcast, the information data including identifying information related to the reproduced audio data; and a microprocessor connected to the tuner and satellite receiver, for processing and decoding the audio and information data within the received satellite broadcast, the microprocessor providing the audio data included within the satellite broadcast to the speaker and the decoded information data to the display screen. The system also includes a print module for generating a printed record including the information data, a memory unit for storing the information data on a memory card and a transmitter for transmitting information to a satellite service provider regarding ordering of data associated with the received satellite broadcast. The print module, memory unit and transmitter may also be controlled by control buttons positioned on a steering wheel of a vehicle in which the system is installed.

5 Claims, 9 Drawing Sheets

SATELLITE ENTERTAINMENT RECEIVER SYSTEM

BACKGROUND OF THE INVENTION

1. Field of the Invention

The present invention relates generally to radio receivers, more specifically to a satellite radio receiver located in a vehicle that allows a listener to create a record of information about the media being broadcast via satellite in either print or digital form and further allows the listener interactive ability to purchase the media being broadcasted.

2. Description of the Prior Art

Numerous types of vehicle receivers and satellite purchasing means have been provided in the prior art. For example, U.S. Pat. Nos. 3,947,882; 5,418,654; 5,572,442; 5,661,787; 5,722,069; 5,734,589; 5,857,156; 5,914,941; 6,067,562; 6,130,727; 6,212,555; and 6,282,491 all are illustrative of such prior art. While these units may be suitable for the particular purpose to which they address, they would not be as suitable for the purposes of the present invention as heretofore described.

U.S. Pat. No. 3,947,882

Inventor: Robert W. Lightner

Issued: Mar. 30, 1976

A vending system includes a central station at which various information stored on master recordings can be selectively accessed by purchasers from any of multiple remote vending machines, the accessed information being reproduced on cartridge-type storage media at that vending machine. The cartridge, upon receiving all of the selected information, is ejected from the vending machine for the permanent use of the purchaser. In a preferred embodiment the master recording medium comprises a plurality of rack-mounted endless master tapes continuously driven by a common capstan. The endless tapes are contained in a cartridge which includes a tape transport and playback head and is readily removable from the rack. The vending machine includes a storage magazine in which blank tapes receive recorded information and are then automatically ejected.

U.S. Pat. No. 5,418,654

Inventor: Robert G. Sheffler

Issued: May 23, 1995

A customized album recording system is under the control of a central microprocessor or mini-computer. A master library or storage medium is filled with a repertoire of recorded information items (such as musical selections) which may originate with any suitable source, such as phonograph records, tapes, sound tracks, compact discs, or the like. Each information item is stored in the library under its own address. On read out, an operator keys in the addresses identifying the selected items which are read out of the library medium and stored in a large capacity memory, usually to provide about forty-five minutes of total listening time. Then, all of the music is read out of that large capacity memory and recorded at a high speed onto a suitable album size medium, such as a tape cassette, for example. The source music and the customized album music are usually recorded in an analog form. The music which is processed within the system is in a digital form. Thus, the various transfers of music from the master storage to the recorded album, may be accomplished at a high speed of digital transmission. In an alternative embodiment, instead of reading out an entire album amount of recorded information items, the central computer successively reads out limited amounts of data on a demand and fetch basis. A computer provides both the analog-to-digital and the digital-to-analog conversions in order to improve fidelity.

U.S. Pat. No. 5,572,442

Inventors: Nathan Schulhof et al.

Issued: Nov. 5, 1996

A distribution system for audio program materials includes a portable audio storage and retrieval device that is programmable from a high speed data transfer system, and that includes a high-capacity data storage medium, a base control interface for identifying and accepting program material, a mobile control interface for displaying the identity of recorded material for playback selection, a recording mechanism for accepting very high speed digital data from an external source at rates faster than real time, and a playback mechanism for retrieving the stored data from the storage medium and for converting the data into audio signals for playback.

U.S. Pat. No. 5,661,787

Inventor: Michael H. Pocock

Issued: Aug. 26, 1997

The system allows radio broadcast listeners to use a telephone to connect to a database that contains prerecorded audio descriptions (e.g. spoken text and/or music) of material played by the radio station. The database is indexed by the radio station's program schedule or play list to allow the user to select a particular audio description of interest (e.g. the song currently airing, the song last played, etc.). Hearing the audio description over the telephone insures the listener that the requested selection is in fact correct. Using the telephone DTMF touch tone controls the listener can place an order to purchase the selected material over the telephone.

U.S. Pat. No. 5,722,069

Inventor: Irah H. Donner

Issued: Feb. 24, 1998

A system for a vehicle having first and second broadcast devices includes an entertainment system for playing a first entertainment by outputting a first signal, and a mobile telephone receiving and playing a second medium by outputting a second signal. The system also includes a controller monitoring the first and second signals output from the entertainment system and the mobile telephone respectively, and outputting a control signal to control switching between the entertainment system and the mobile telephone and first and second broadcast devices responsive to the first and second signals. A switch connects the entertainment system and the mobile telephone responsive to the control signal received from the controller. When the controller detects the first and second signals output from the entertainment system and the mobile telephone, the controller controls connections between the entertainment system and the mobile telephone.

U.S. Pat. No. 5,734,589

Inventor: Bruce Kostreski

Issued: Mar. 31, 1998

Dynamic programming of a digital entertainment terminal (DET) facilitates operation of the terminal to offer a variety of functionally different broadband services. The terminal includes a network interface module which couples the terminal to a specific type of communication network for receiving a digital broadband channel. The DET downloads on a narrowband signaling channel a VIP program map that identifies the available video information service providers (VIPs) on the basis of the location of their corresponding software control signals. The software control signals are transmitted cyclically to enable access by a random DET at any time. A program memory captures the VIP program map and at least a portion of the software control signals received over the digital broadband channel as software executable by the control processor during turn-on of the DET. When a user presses a GUIDE button on a remote control service, the DET displays the available information service providers in accordance with the VIP program map, thereby enabling the user to conveniently access the broadband services offered by the selected information service provider.

U.S. Pat. No. 5,857,156

Inventor: John R. Anderson

Issued: Jan. 5, 1999

The present invention relates to an electronic system for purchasing an item where the system has at least one home station and at least one remote device (56). More particularly, the present invention is directed to a method or means for purchasing the item by entering a code into the remote device (56). The remote device (56) of the present invention is in the form of a pager and/or a radio.

U.S. Pat. No. 5,914,941

Inventor: James M. Janky

Issued: Jun. 22, 1999

A digital replacement for an analog audio tape recorder can record audio programming digitally in a faster than real time format and can play back audio programming, where such programming has been digitized and stored in data files using a variety of compression/decompression algorithms. Audio programming is stored digitally on a non-volatile medium, such as a hard drive, or in a flash EPROM, or other solid state non-volatile memory. The device includes a hard drive, a modem for connection to a data base via an on-line service, a keyboard, a display, and an audio system. The device uniquely combines the remote data access capability resident in a personal computer with a set of tailored, streamlined control functions to simplify, automate, and render seamless the process of selecting audio program material; ordering the program material from a service; receiving acknowledgment of the order and receiving the program material via automatic download for storage in a hard drive; playback of the program material when and where the user desires, with fully streamlined control functions; and control of the user interface functionality on the keyboard through a setup mode of operation.

U.S. Pat. No. 6,067,562

Inventor: Robert J. Goldman

Issued: May 23, 2000

A digital radio broadcast station which includes a common digital database having stored therein a plurality of at least several hundred (preferably at least 1800) different selections of music to be played and broadcast by the radio station. A processor system is provided for programming the operation of the digital radio broadcast station with a sequence of music selections, which are subsequently retrieved in order from the common digital database and played over the digital radio broadcast station. The processor system preferably includes a main computer system for operating the radio station, and also a backup computer system for operating the radio station in the event of a failure of the main computer system. The processor system is preferably based upon reduced instruction set computing architecture, and preferably comprises an IBM RS/6000 system with an AIX operating system. The common digital database comprises a disk array storage, preferably a dual port RAID disk array. The digital radio broadcast station also includes a plurality of work station consoles for use by personnel responsible for operating the radio station such as disc jockeys and engineers.

U.S. Pat. No. 6,130,727

Inventor: Morihiko Toyozumi

Issued: Oct. 10, 2000

There is described an on-vehicle unit which permits removal and attachment of various optional modules from and to a center module and which enables easy addition and removal of various functions. The on-vehicle unit is provided in a dashboard of a vehicle, and a center module—into which there are built as standard devices a radio receiving unit and a car navigation unit—has a plurality of module loading sections. Optional modules, such as a television tunermodule, a cassette deck module, and a VICS module, can be built into the center module, as required. The center module (7) has a central control section for controlling the standard units and various optional modules. The control mode of the control section is switched according to a combination of optional modules to be built into the center module.

U.S. Pat. No. 6,212,555

Inventor: William E. Brooks, Jr. et al.

Issued: Apr. 3, 2001

A system for providing recorded audio programming in digital form, comprising a computer server capable of digitally recording, holding and uploading audio programming in either musical or voice formats and able to transmit such modulated digital data in a time-compressed, encrypted and encoded manner through a wireless transmission, where the data is received using RF electronics, then stored for transfer to a combination audio receiver/player/data storage device. The storage device comprises a readable/writable memory storage mechanism (e.g., disk drive, hard drive, memory or flash card system) and playback or player feature interfaced with a mobile or fixed site RF receiver capable of receiving wireless transmissions. As the transmissions are received, the programming data is demodulated and stored in digital form and then converted to "real time" audio one file at a time, utilizing a digital-to-analog converter, and played back to the listener.

U.S. Pat. No. 6,282,491

Inventors: Harald Bochmann et al.

Issued: Aug. 28, 2001

A telematic device in which a car radio with an RDS module, a wireless telephone, and a positioning and navigation system are provided in one housing. The housing is designed so that it can be installed in a standard bay in the instrument panel of a motor vehicle. The telematic device can be used to receive general information via the car radio as well as specific information via the GSM module. In addition, data relating to, for example, the vehicle position, a desired destination, or an emergency call can be sent to the central station. The central station calculates one or more routes and transmits them back to the telematic device. In the event of an accident or a vehicle breakdown, an emergency call is transmitted and assistance obtained. Additional telematic services provided include an expanded anti-theft system for the motor vehicle, hotel reservations, etc.

SUMMARY OF THE PRESENT INVENTION

The present invention relates generally to radio receivers, more specifically to a satellite or digital radio receiver located in a vehicle that allows a listener to record information about the media being broadcast via satellite in either print or digital form and further allows the listener interactive ability to purchase the media being broadcasted.

A primary object of the present invention is to provide consumer selectivity via satellite entertainment receiver that will overcome the shortcomings and inconveniences of prior art devices.

Another object of the present invention is to provide satellite entertainment receiver that allows a user in a vehicle to receive satellite broadcasts through different platforms such as Digital Audio Band (DAB), In-Band On-Channel (IBOC), or Multimedia Broadcasting System (MMBS), XM Radio, Sirius Satellite Radio or any platforms using similar technologies.

A further object of the present invention is to provide satellite entertainment receiver which is able to receive encoded bits of data containing information about the media being played by the satellite entertainment receiver.

A yet further object of the present invention is to provide satellite entertainment receiver wherein the information about the media being played on the satellite entertainment receiver can be recorded for later use.

A still further object of the present invention is to provide satellite entertainment receiver including a printing module used to create a printout of the information about the media being played on the satellite entertainment receiver.

A further object of the present invention is to allow for retailers to transmit offers or discount coupons that can be printed by using the print module thereby allowing the retailers a broader reach of consumers.

A still further object of the present invention is to have replacement printing paper imprinted with a retailers logo.

A still further object of the present invention is to provide satellite entertainment receiver further including a memory chip that stores the information about the media being played on the satellite entertainment receiver in digital form for later use.

A further object of the present invention is to provide satellite entertainment receiver wherein the memory chip is compatible with personal computers and/or person digital assistants.

An even further object of the present invention is to allow for reception of information such as news, stock quotes, weather, sports, or any other relevant information that can be broadcasted on a LCD display screen and or printed using the print module.

A yet further object of the present invention is to provide satellite entertainment receiver that allows a user to associate a credit or checking account with the unit which would allow the user to purchase the media being broadcasted from a retailer and have it delivered to the users home.

An even further object of the present invention is to provide satellite entertainment receiver that is able to convert data broadcast in a language other than English into English and from English to a desired language.

A still further object of the present invention is to provide satellite entertainment receiver including control buttons conveniently located on a steering column of a vehicle for easy access to a driver of the vehicle.

Another object of the present invention is to provide satellite entertainment receiver that is simple and easy to use.

A still further object of the present invention is to provide satellite entertainment receiver that is economical in cost to manufacture.

Additional objects of the present invention will appear as the description proceeds.

A satellite entertainment receiver that receives digitally encoded broadcasts and plays the received broadcasts in the users vehicle. The satellite entertainment receiver allows the user to digitally record the information about the broadcasted media and/or allows the user to create a printout of the same information using a print module. Also, other information may be transmitted via satellite such as news stories, stock quotes, sports and weather and that information may be displayed on the LCD screen. Further, the satellite entertainment receiver can be linked to a credit account which enables the user to purchase the selected media and have it shipped to a desired location.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views.

DESCRIPTION OF THE REFERENCED NUMERALS

Figure 1:
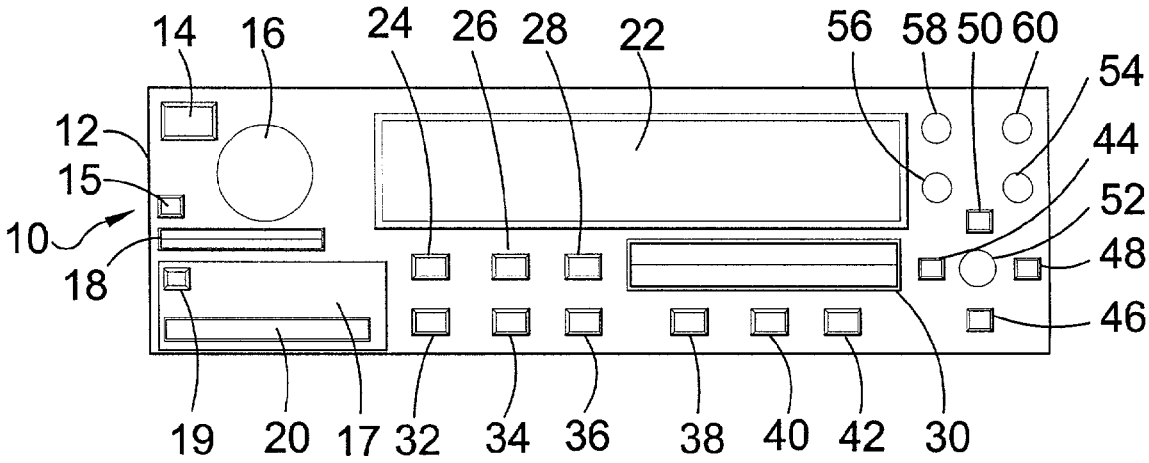
FIG. 1 is a front view of the satellite entertainment receiver of the present invention.

Turning now descriptively to the drawings, in which similar reference characters denote similar elements throughout the several views, the Figures illustrate the remote video camera of the present invention. With regard to the reference numerals used, the following numbering is used throughout the various drawing figures.

10 satellite entertainment receiver of the present invention
11 front side of the main body
12 main body
13 memory card
14 power button
15 memory card eject button
16 adjustment knob
17 print module
18 memory card slot
19 print module eject button
20 printout slot
22 display screen
24 store button
26 print button
28 purchase button
30 tape deck
32 preset 1/rewind button
34 preset 2/play button
36 preset 3/fast forward button
38 preset 4/stop button
40 preset 5/pause button
42 preset 6/auto-reverse button
44 back button
46 down button
48 forward button
50 up button
52 select button
54 tape/radio button
56 Band
58 bass adjust knob
60 terrible adjust knob
61 rear side of the main body
62 antenna connection port
64 power connection port
68 printout
70 print module drawer
72 roll of paper
74 dowel
75 hinge
76 paper holding/guiding means
78 printer
80 microprocessor
82 tuner
84 satellite receiver
86 transmitter
88 read only memory
90 tape deck/CD player
92 tape/CD control buttons
94 tuner control buttons
96 speakers
98 dashboard of vehicle
100 steering wheel of vehicle
102 control buttons on steering wheel
104 save button on steering wheel
106 print button on steering wheel
108 order button on steering wheel

DETAILED DESCRIPTION OF THE PREFERRED EMBODIMENT

Turning now descriptively to the drawings, in which similar reference characters denote similar elements throughout the several views, FIGS. 1 through 6 illustrate the satellite entertainment receiver of the present invention indicated generally by the numeral 10.

Figure 8:
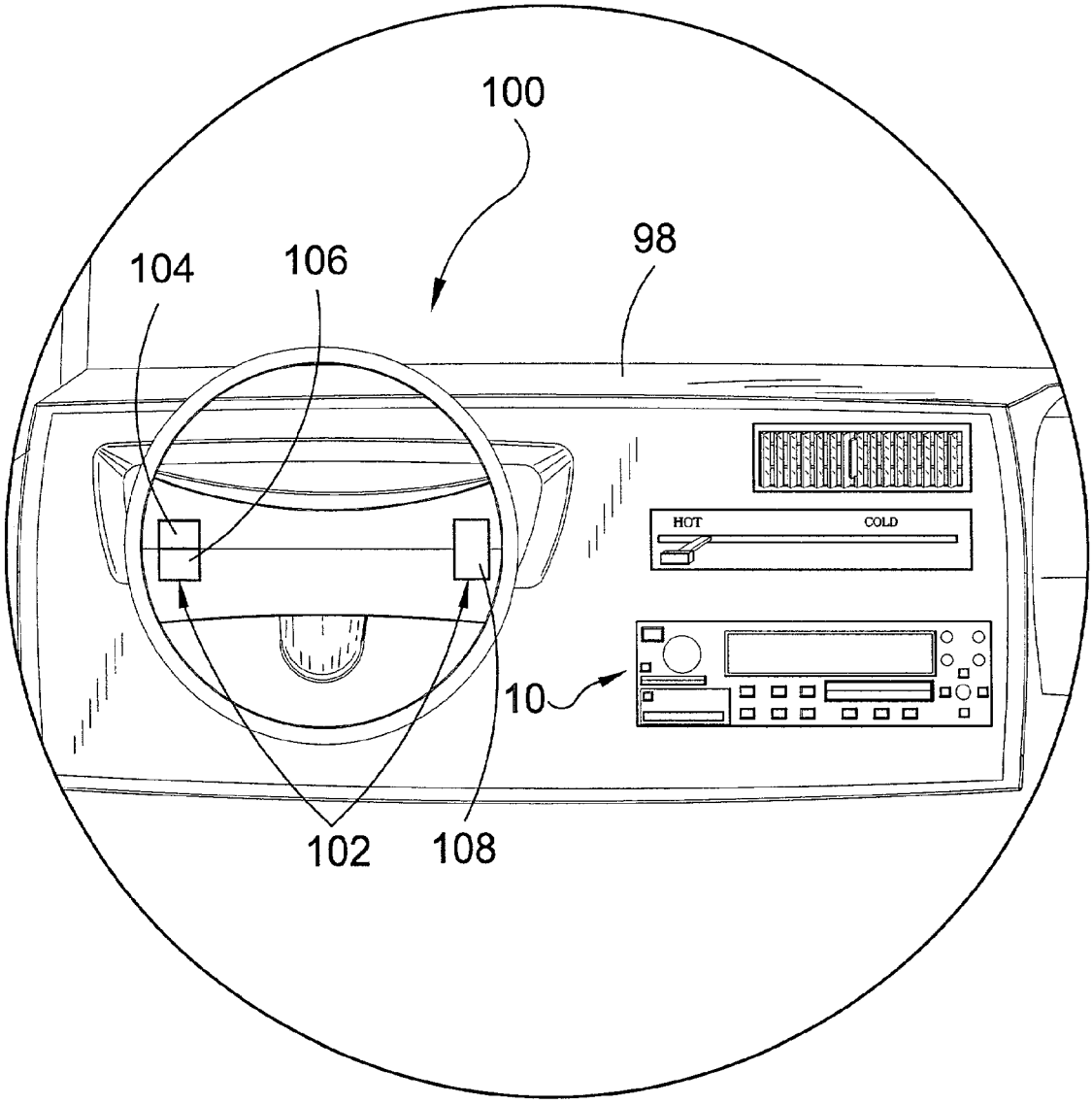
FIG. 8 is a perspective view of the satellite entertainment receiver of the present invention positioned within a dashboard of a vehicle.

A front view of the satellite entertainment receiver 10 is shown in FIG. 1. The satellite entertainment receiver 10 consists of a main body 12 and is primarily for use in vehicles. However, the satellite entertainment receiver 10 may be used in any desired type of environment. The satellite entertainment receiver 10 receives satellite broadcasts for reproduction in a user's vehicle when power is supplied thereto. A perspective view of the satellite entertainment receiver 10 positioned within a dashboard of a vehicle is illustrated in FIG. 8. As can be seen from this Figure, the satellite entertainment receiver 10 is positioned similarly to a conventional radio within a dashboard 98 of the vehicle. As can be seen from this figure, the steering wheel 100 also includes control buttons 102 to provide convenient use of the satellite entertainment receiver 10 for the driver. The steering wheel will be described in greater detail hereinafter with specific reference to FIG. 9.

The main body 12 of the satellite entertainment receiver 10 has a front side 11. The satellite entertainment receiver 10 is connected to a power source within the vehicle such as the vehicle battery (not shown) and the satellite entertainment receiver 10 is turned ON by depressing power button 14. The front side 11 of the satellite entertainment receiver 10 has a tape deck 30. A user can switch between tape and satellite mode by pressing tape/satellite button 56. When in tape mode, the tape deck 30 is controlled by preset 1/rewind button 32, preset 2/play button 34, preset 3/fast forward button 36, preset 4/stop button 38, preset 5/pause button 40, and preset 6/auto-reverse button 44. When in satellite mode a user can selectively tune a satellite broadcast by using the left button 44, the down button 46, the right button 48, the up button 50, and the select button 52. The satellite entertainment receiver 10 allows for preset stations to be stored in a memory using preset 1/rewind button 32, preset 2/play button 34, preset 3/fast forward button 36, preset 4/stop button 38, preset 5/pause button 40, and preset 6/auto-reverse button 44.

Located on the front side 13 of main body 12 is a screen 22. The screen 22 is used to display information concerning the media broadcast being received by the satellite entertainment receiver 10. The information displayed on the screen 22 includes data concerning at least one of the station from where the broadcast originates, the name of the media being played through the satellite entertainment receiver, the author of the media being played through the satellite entertainment receiver, and the name of the collection where the media can be found (i.e. the name of an album where the song is found). Other information received by the satellite entertainment technology that can be displayed on the display screen 22 includes at least one of news briefs, stock quotes, weather information, and sports information. The information displayed on screen 22 is received by the satellite entertainment receiver 10 and is decoded for display on the screen.

The front side 11 of the main body 12 also contains a memory card slot 18 and memory store button 24. A user can insert a memory card 13 into memory slot 18 for storage of the information displayed on the screen 22. The memory card 13 is selectively removable by depressing the memory card eject button 15. The memory card 13 is compatible with personal computers and personal digital assistants so as to allow the user to manipulate the information obtained from decoding a satellite broadcast signal. The storage of information on the memory card 13 is controlled by a memory store button 24. A print module 17 is also shown on the front side 11 of the main body 12. The print module 17 includes a printout slot 20 and a print module eject button 19. A print button 26 controls the functions of the print module 17. The print module 17 makes a printout of the decoded information displayed on screen 22.

Further contained on the front side 11 of the main body 12 is a purchase button 28. The purchase button 28 is linked to a satellite service. After the user views the information on the screen 22 and decides to purchase the media displayed on the screen 22, the user depresses the purchase button 28 and is linked to a satellite operator via a transmitter that assists the user in making the purchase.

Figure 2:
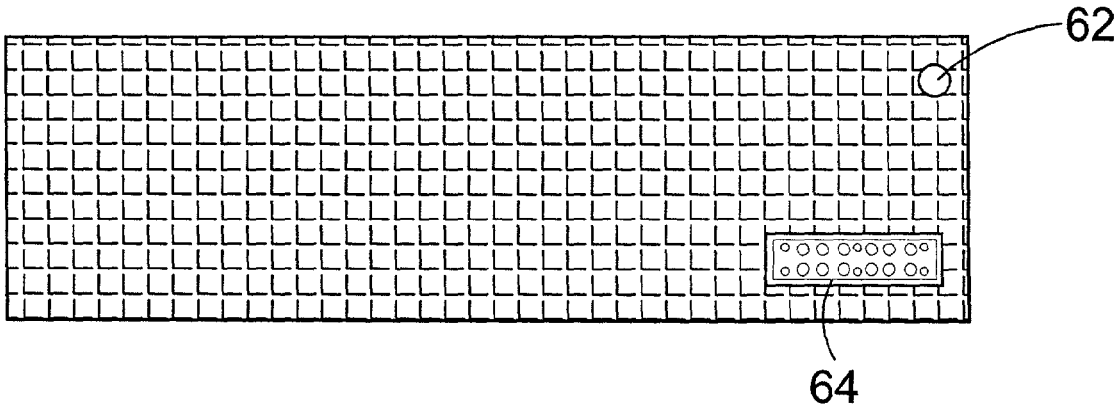
FIG. 2 is a rear view of the satellite entertainment receiver of the present invention.

FIG. 2 is a rear view of the satellite entertainment receiver 10 of the present invention showing a rear side 61 thereof. The rear side 61 of the main body 12 contains connection ports for use in connecting the satellite entertainment receiver 10 to the vehicle. The connection ports include an antenna connection port 62 for connecting the satellite entertainment receiver 10 to an antenna of the vehicle. A power connection port 64 connects the satellite entertainment receiver 10 to the power supply of the vehicle.

Figure 3:
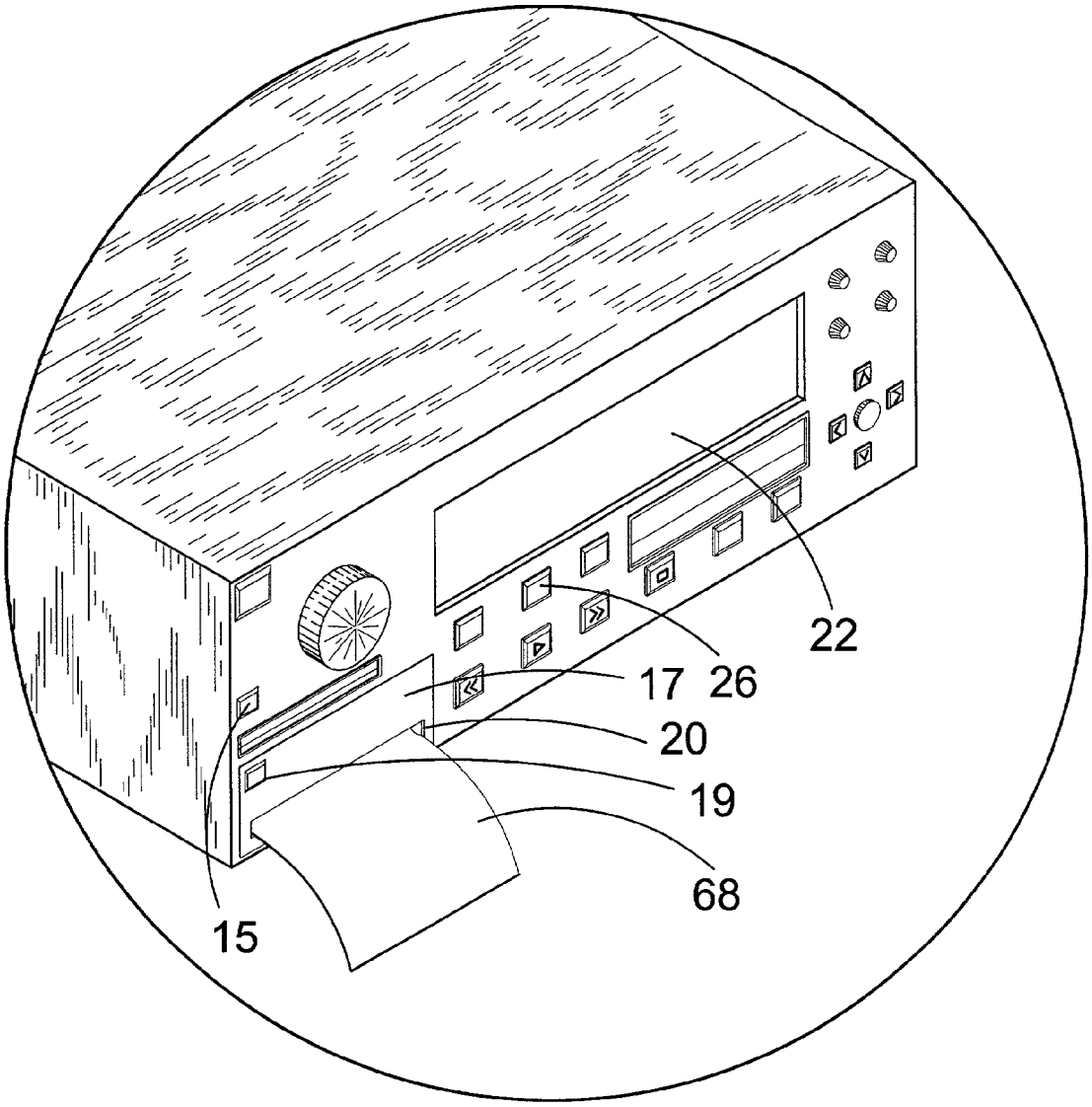
FIG. 3 is a front perspective view of the satellite entertainment receiver showing a printout containing the information about the media being broadcasted on the satellite entertainment receiver of the present invention.

FIG. 3 is a front perspective view of the satellite entertainment receiver 10 illustrating the print module 17 in an activated state. The print module 17 is able to be activated when the satellite entertainment receiver 10 is receiving an encoded broadcast or after data has been saved by the satellite entertainment receiver 10. Once decoded, the information contained within the encoded broadcast is displayed on the screen 22. A user activates the print module 17 by depressing print button 26. Thereafter, the information is sent via electronic circuits to the print module 17 and a printout 68 is generated and provided to the user through the print slot 20. The preferred method of printing used by the print module is thermal printing so as to prevent or minimize the need to replace traditional printing resources such as toner, ink, or ribbon. The print module can be removed from the satellite entertainment receiver 10 by pressing print module eject button 19. Removing the print module 17 from the main body 12 allows for replacement of paper and cleaning of print heads as well as replacement of toner if necessary.

Figure 4:
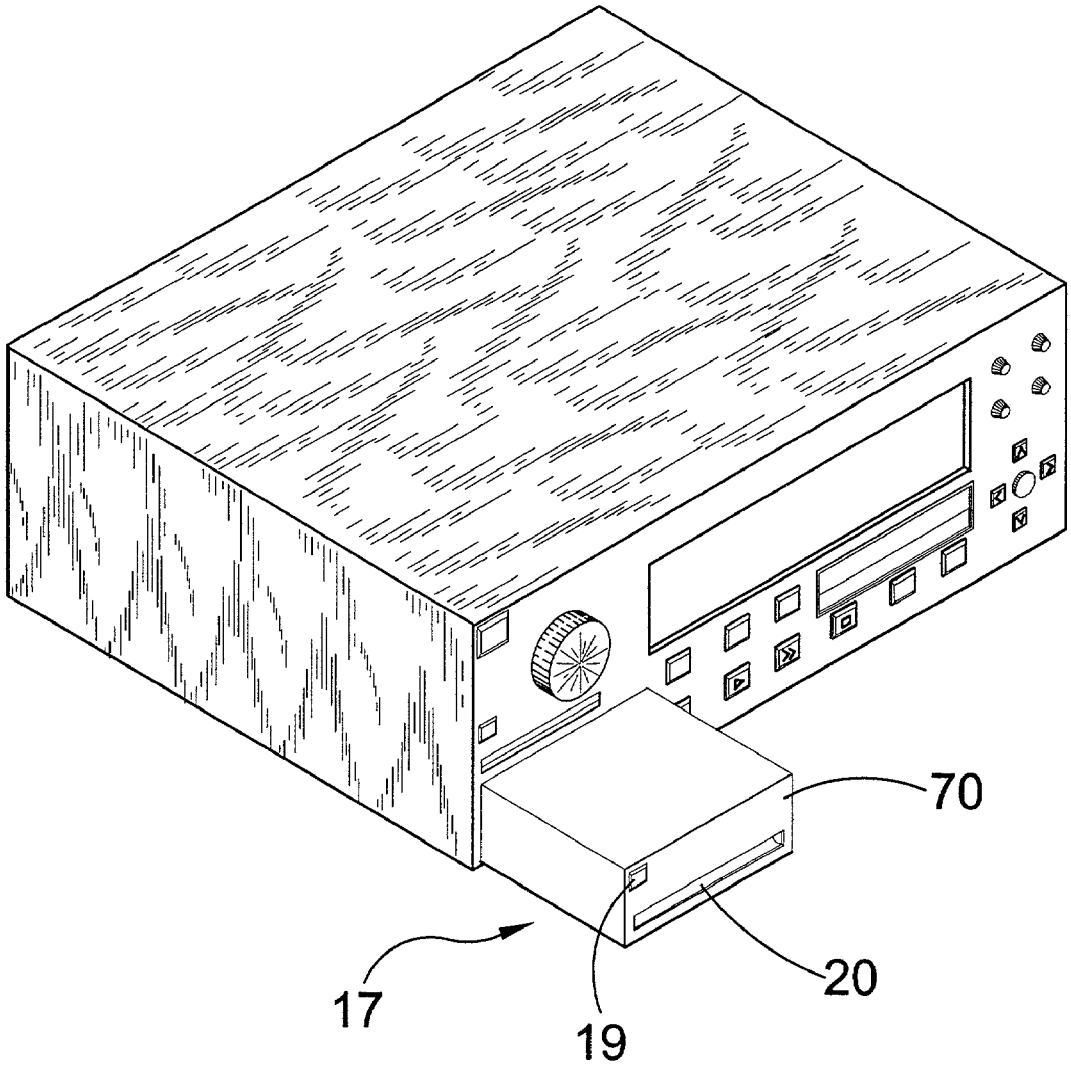
FIG. 4 is a front perspective view of a the print module of the satellite entertainment receiver of the present invention, the module is shown extended from the front of the satellite entertainment receiver as it would be when replacing the paper for the print module.
Figure 5:
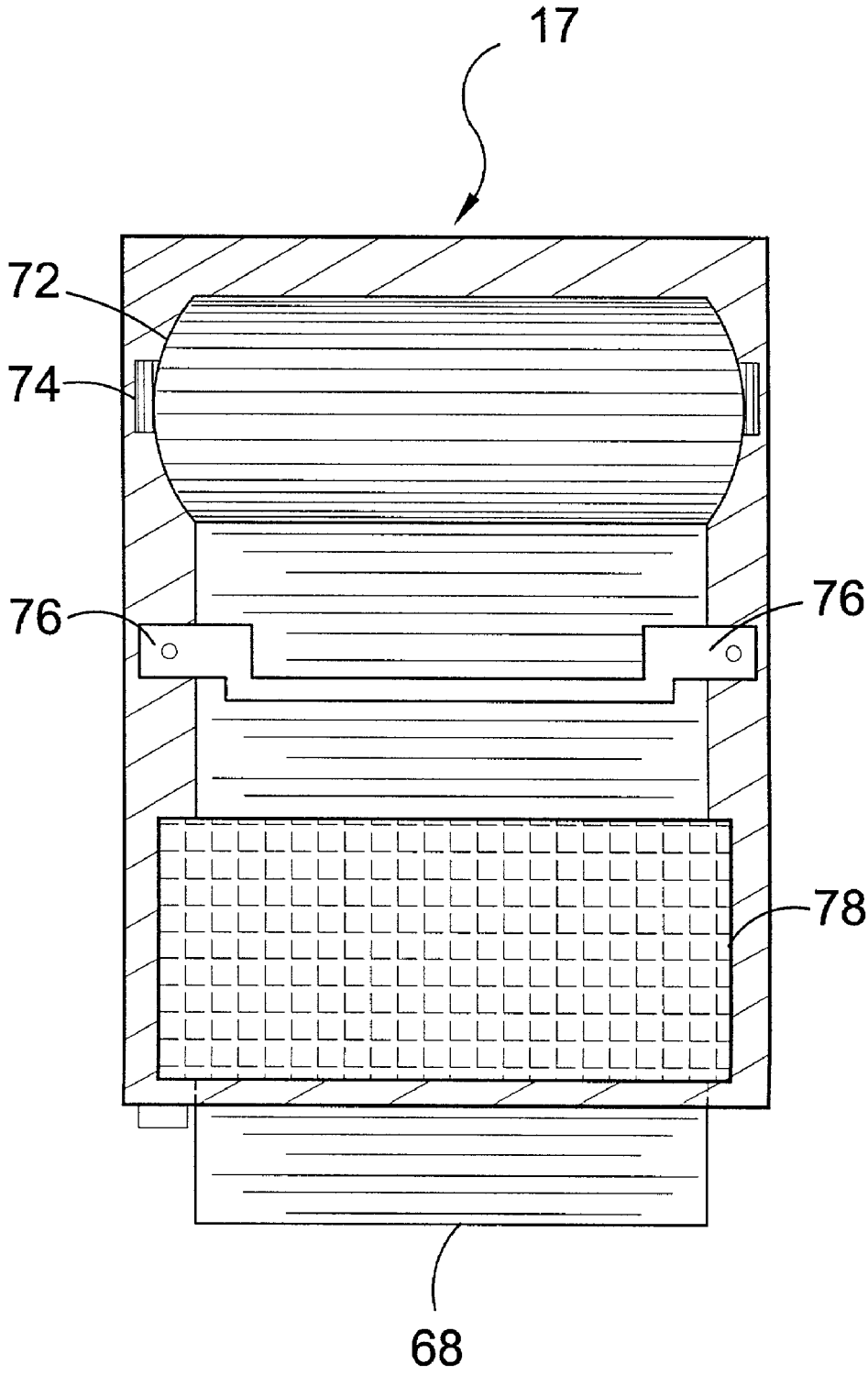
FIG. 5 is an enlarged top view of the print module of the satellite entertainment receiver of the present invention showing the position of the paper and printer.

FIG. 4 shows a front perspective view of the satellite entertainment receiver 10 with the print module 17 ejected from the main body 12 thereof. The print module 17 extends at least partially through the main body 12 of the satellite entertainment receiver 10. The print module 17 is ejected from the main body 12 by pressing the print module eject button 19. The print module is contained within the printer drawer 70. FIG. 5 is a top view of the printer drawer. A dowel 74 holds a roll of paper 72 in place within the printer drawer 70. The paper 68 is held and guided by holding/guiding means 76. The holding/guiding means 76 are attached to the base of the printer drawer 70 and have a hinge to allow for easy re-loading of paper. When re-loading the paper 68, the hinge 75 of the holding/guiding means 76 is in an up position. The paper 68 is then fed through the print head 78 and extended through the print slot 20. After being extended through the print slot 20, the hinge 75 of the holding/guiding means 76 is put into a down position thereby securing the paper 68 and keeping it on track.

Figure 6:
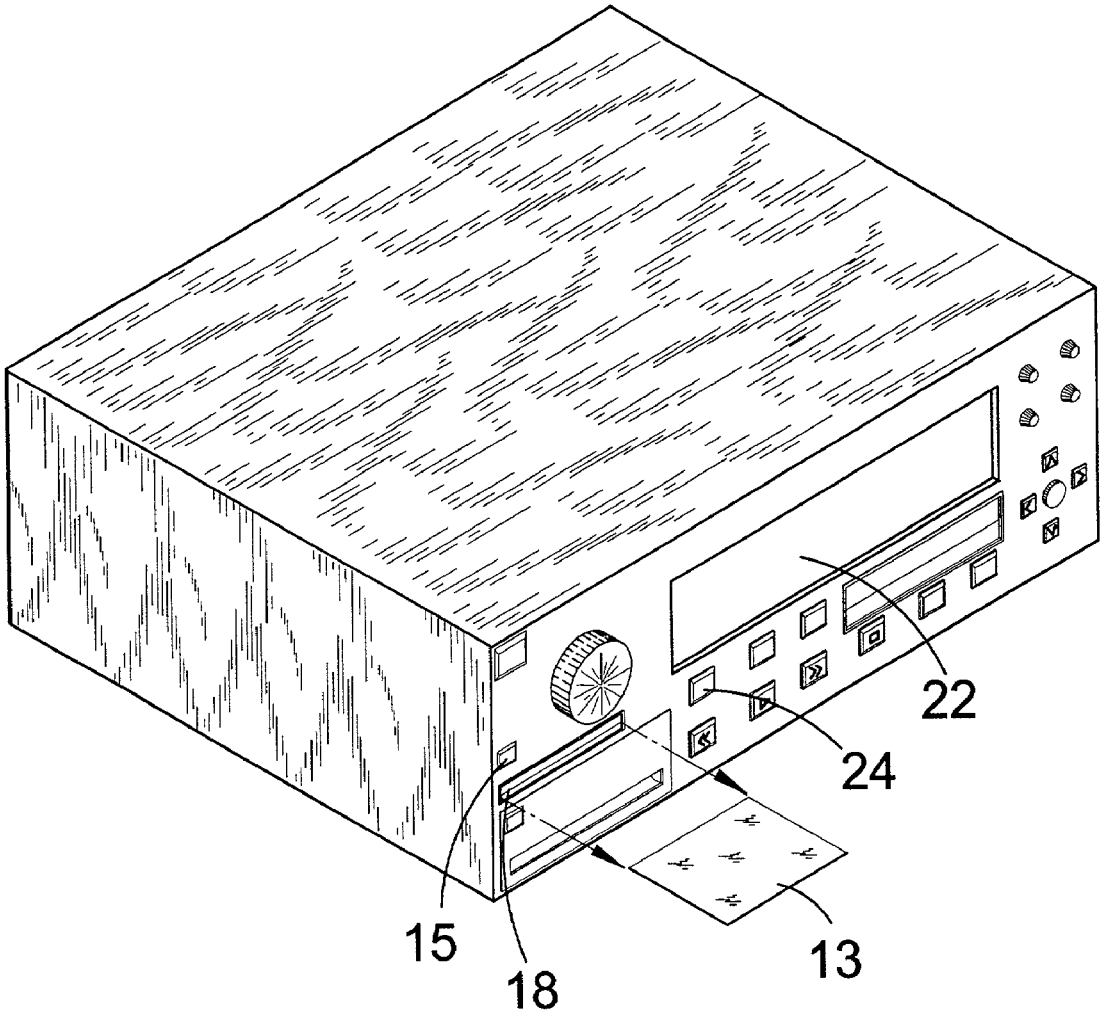
FIG. 6 is a front perspective view of the satellite entertainment receiver of the present invention, showing a memory card ejected from the satellite entertainment receiver.

FIG. 6 shows a front perspective view of the satellite entertainment receiver 10 with a memory card 13 ejected from the main body 12 thereof. The memory card 13 is inserted into the memory card slot 18. The memory card 13 is available to receive data when the satellite entertainment receiver 10 is in satellite mode and is receiving an encoded broadcast. Once decoded, the information contained within the encoded broadcast is displayed on the screen 22. A user activates the memory card 13 by depressing the store button 24. Thereafter, the information displayed on the screen 22 is transferred via electronic circuits to the memory card 13 where it is digitally stored. The memory card 13 is compatible with personal computers and personal digital assistants therefore it has a finite memory. The user can selectively remove the memory card 13 from the memory card slot 18 by pressing a memory card eject button 15. After ejecting a memory card 13, a user can place the memory card in a device able to read the memory card 13 such as a personal computer or a personal digital assistant in order to manipulate and use the information saved from the satellite entertainment receiver 10. Data stored by the memory card may also be printed by the print module 17 upon activation of the print button 26.

Figure 7:
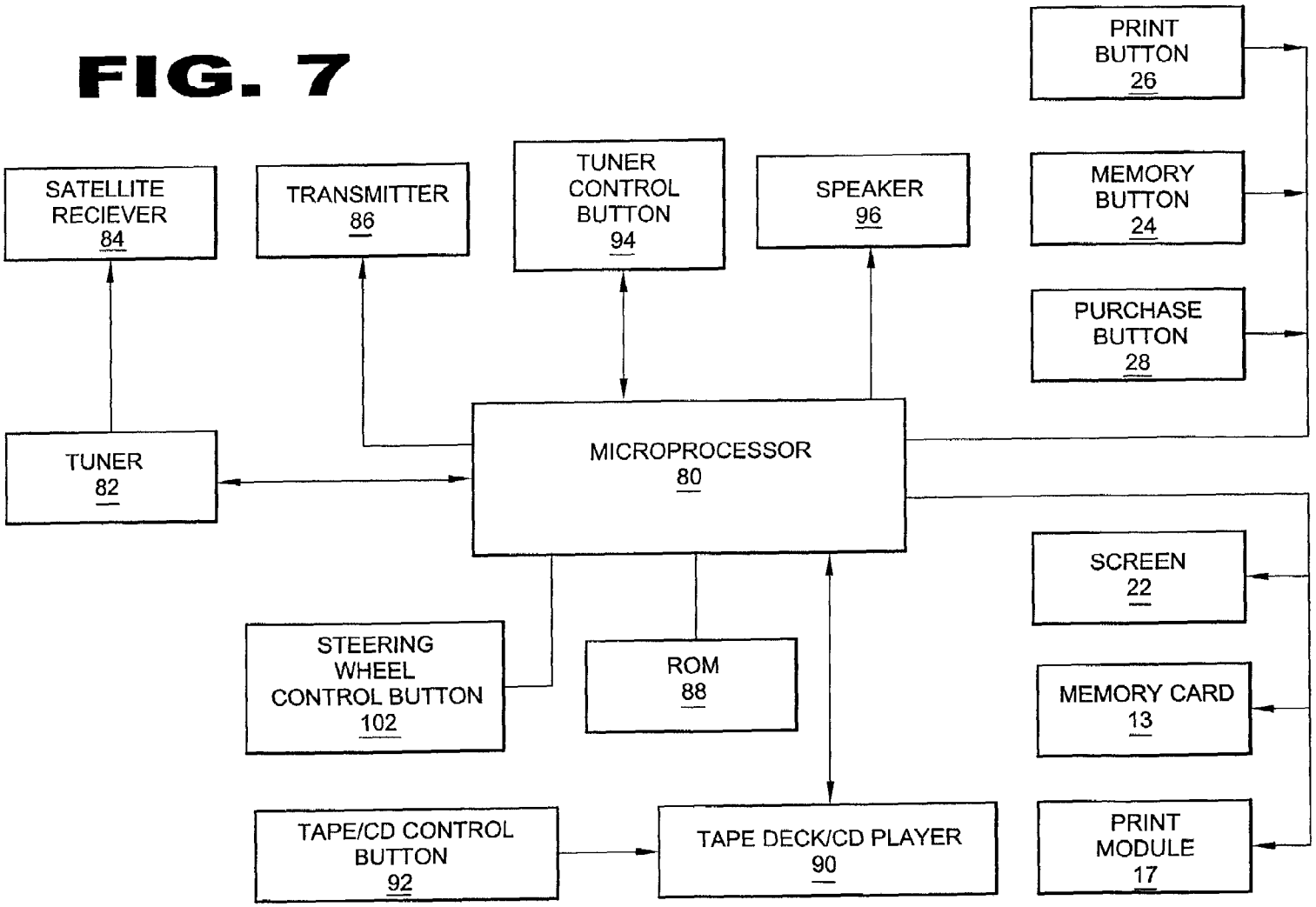
FIG. 7 is an electronic block diagram of the satellite entertainment receiver of the present invention.
Figure 9:
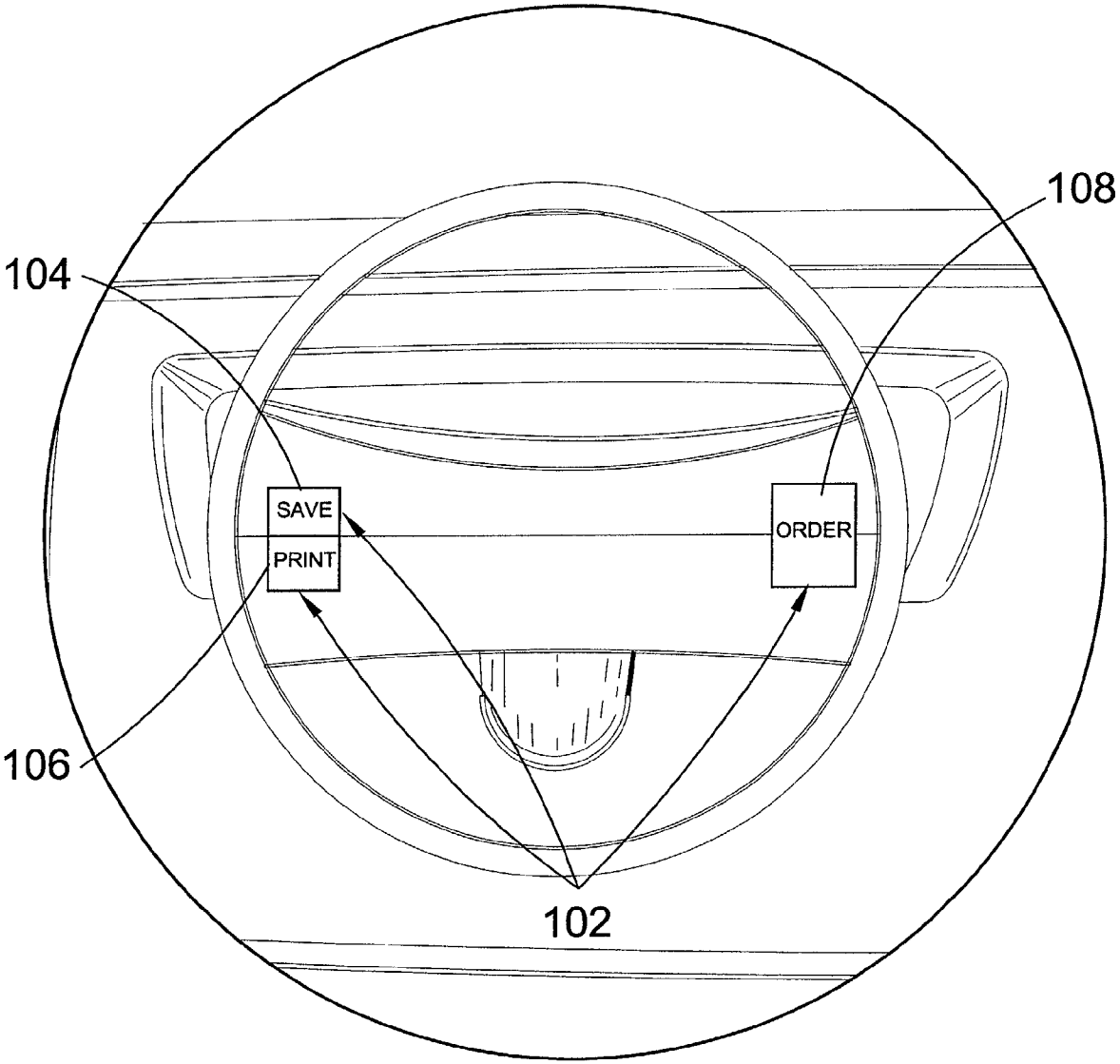
FIG. 9 is a perspective view of a steering wheel for use with the satellite entertainment receiver of the present invention.

FIG. 7 is an electronic block diagram of the satellite entertainment receiver 10 of the present invention. The satellite entertainment receiver 10 includes a microprocessor 80. Connected to the microprocessor 80 are tuner control buttons 94 for activating and controlling the microprocessor 80. The tuner control buttons 94 generate and transmit a signal to the microprocessor 80 upon activation. A ROM 88 is connected to and stores instructions for use by the microprocessor 80 in controlling the tuner 82. The tuner 82 tunes the satellite receiver 84 to receive a broadcast transmitted at a desired frequency. The broadcast is then sent to the microprocessor 80 where it is decoded. The transmitted satellite broadcast is decoded by the microprocessor 80 using instructions stored within the ROM 88. The satellite broadcast is transmitted in two parts, audio data and information data which are decoded and separated by the microprocessor 80 for use by the satellite entertainment receiver 10. The microprocessor 80 outputs the decoded audio data to speakers 96 for reproduction thereby. The microprocessor 80 outputs the information data to the screen 22 connected thereto. The information data displayed on the screen 22 includes data indicative of at least one of the station from where the broadcast originates, the name of the media being played through the satellite entertainment receiver, the author of the media being played through the satellite entertainment receiver, and the name of the collection where the media can be found (i.e. the name of an album where the song is found). The print module 17 is connected to the microprocessor 80 for generating a printout of desired data. By pressing the print button 26, a signal is sent to the microprocessor 80 to take information data decoded thereby and currently displayed on the screen 22, and output that information data to the print module 17. Also, by pressing the memory button 24, a signal is sent to the microprocessor 80 to take the information data decoded thereby and currently displayed on the screen 22, and output the information data to a memory card 13. By depressing the purchase button 28, the user send a signal to the microprocessor 80 that causes the microprocessor 80 to take the information data decoded from the satellite broadcast and send that information data to a transmitter 86. The transmitter 86 is a satellite transmitter that transmits the information to a satellite service provider that receives the information and arranges for the purchase and delivery of the material in the original satellite broadcast to a location indicated by the user. The satellite entertainment receiver 10 also includes at least a tape deck and a compact disk player 90. The tape deck/CD player 90 is controlled by tape/CD control buttons 92. The tape deck/CD player is connected to the microprocessor 80 and when in operation the microprocessor outputs the audio signal to the speakers 96. The printing, storing data and ordering functions described above may also be performed by activating control buttons 102 located on the steering wheel. The control buttons 102 are connected to the microprocessor 80 and operate in a manner similar to the control buttons provided on the front side of the main body. A steering wheel 100 for use with the satellite entertainment receiver 10 is illustrated in FIG. 9. As can be seen in this figure, the steering wheel includes a save button 104, a print button 106 and an order button 108. Upon activation of the memory button 104, a signal is sent to the microprocessor 80 to take the information data decoded thereby and currently displayed on the screen 22, and output the information data to a memory card 13. Upon activating the print button 106, a signal is sent to the microprocessor 80 to take information data decoded thereby and currently displayed on the screen 22, and output that information data to the print module 17. Upon activation of the purchase button 108, the user send a signal to the microprocessor 80 that causes the microprocessor 80 to take the information data decoded from the satellite broadcast and send that information data to a transmitter 86. The transmitter 86 is a satellite transmitter that transmits the information to a satellite service provider that receives the information and arranges for the purchase and delivery of the material in the original satellite broadcast to a location indicated by the user.

Certain satellite broadcasts are transmitted in languages other than that with which the user is familiar. In the event, the user is not familiar with the language being transmitted, the processor 80 translates the information data transmitted with the received satellite broadcast into the native language of the user. The language into which the processor converts the information data is preprogrammed into the satellite entertainment receiver and thus the user is able to receive a display and printout of the information data in a desired language. The processor 80 is able to convert the information data from any desired language to any other desired language.

The operation of the satellite entertainment receiver 10 will now be described with reference to the figures. In operation, the tuner 82 of the satellite entertainment receiver 10 is tuned to a desired frequency and receives a satellite broadcast from the satellite receiver 84 transmitted at the tuned frequency. The satellite broadcast is decoded by the microprocessor 80 using instructions contained within the ROM 88. The decoded broadcast is spilt into audio data and information data. The information data is output to the speakers 96 whereas the information data is output for display on the screen 22. The information data displayed on the screen 22 includes data indicative of at least one of the station from where the broadcast originates, the name of the media being played through the satellite entertainment receiver, the author of the media being played through the satellite entertainment receiver, and the name of the collection where the media can be found (i.e. the name of an album where the song is found).

A user can create a digital record of the information data by depressing the memory button 24 or 104. The memory button 24 signals the microprocessor 80 to output the information data onto a memory card 13. The memory card 13 is of the type that is commonly used by personal computers or personal digital assistants and has a finite amount of memory. The user can store as much information data as the finite amount of memory of the memory card will allow. The memory card 13 can then be removed by pressing the memory card eject button 15. The ejected memory card 13 can then be used with any device that is able to receive the memory card. The user can use the information stored thereon for purposes including but not limited to archiving, creating a database, or creating a "wish-list" of desired recordings.

A user can also create a printed record of the information data decoded by the microprocessor 80. By depressing the print button 26, 106 a signal is sent to the microprocessor 80 causing the microprocessor 80 to output the decoded information data to the print module 17. The print module 17 houses the printer 78 that preferably uses a thermal printing method to create a record of the information data. The printer module 17 uses a thermal printing method to prevent the need to change traditional printing resources such as toner or ribbon. The printout 68 thereby creates a convenient record of the information data for the user. The user can then take printed record 68 from the print module 17 and it may be used for any activity including but not limited to, having a convenient record to enter a store and make a purchase.

A user can depress the purchase button 28, 108 which signals the microprocessor 80 to output the information data to a transmitter 86. The transmitter 86 communicates with a satellite service provider of which the user is previously a member thereof. The satellite service provider can make arrangements for the purchase and delivery of the broadcast to the user, using payment and delivery information previously set forth by the user.

The satellite entertainment technology of the present invention has beneficial uses for both retailers and consumers. The satellite entertainment technology allows the consumers to create a record of the information received by the satellite entertainment technology. The satellite entertainment technology helps retailers by allowing them a broader range of customers. Retailers, through on-air advertising can have those offers decoded by the satellite entertainment technology and then printed using the print module included therein. Also, retailers can make replacement printer paper having their logo imprinted thereon. This would assist in greater consumer awareness of specific retailers.

From the above description it can be seen that the satellite entertainment receiver of the present invention is able to overcome the shortcomings of prior art devices by providing a satellite entertainment receiver which is able to receive encoded satellite broadcasts, decode them thereby providing the user with information about the media being received by the satellite entertainment receiver, and further allowing the user to create a print or digital record of that information. The satellite entertainment receiver further allows for a user to remotely transmit a purchase order for the media being received by the satellite entertainment receiver. Furthermore, the satellite entertainment receiver of the present invention is simple and easy to use and economical in cost to manufacture.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A satellite entertainment receiver system for receiving satellite broadcasts, said satellite entertainment receive comprising:

a) a satellite receiver for receiving the satellite broadcasts;

b) a tuner for tuning said receiver to a satellite broadcast transmitted at a desired frequency;

c) speakers for reproducing audio data within the satellite broadcast;

d) a display screen for displaying information data within the satellite broadcast, the information data including identifying information related to the reproduced audio data; and e) a microprocessor connected to said tuner and said satellite receiver, for processing and decoding the audio and information data within the received satellite broadcast, said microprocessor providing the audio data included within the satellite broadcast to the speaker and the decoded information data to the display screen, f) a print module connected to said microprocessor, whereby said print module generates a printed record including the information data within the received satellite broadcast upon receipt of a print command from said microprocessor;

g) a print eject button for selectively detaching said print module from said satellite entertainment receiver;

h) a memory unit, said memory unit capable of receiving a memory card, whereon the information data can be digitally stored;

i) a memory card eject button for selectively removing the memory card from said memory unit, wherein information data stored on the memory card is readable by at least one of a personal computer and personal organizer;

j) means for transmitting information to a satellite service provider regarding ordering of data associated with the received satellite broadcast, wherein said transmitting means includes:

i) an order button connected to said microprocessor; and ii) a transmitter, wherein upon activation of said order button, said microprocessor controls said transmitter to transmit ordering data to the satellite service provider, said satellite service provider processes said ordering data and provides a recording medium containing desired data indicated by said ordering information to a user, wherein said receiver is positioned within a vehicle; and k) control buttons positioned on a steering wheel of the vehicle, wherein said control buttons include a print button for activating said print module, a save button for activating said microprocessor to save the information data on said memory card and an order button for activating said transmitting means.

2. The system as recited in claim 1, further comprising a read only memory connected to the microprocessor, wherein the audio and information data within the received satellite broadcast is decoded by said microprocessor using instructions stored within said read only memory.

3. The system as recited in claim 1, wherein said print module includes:

a) a print head for printing the information data;

b) means for holding a roll of paper;

c) a track along which the paper is fed; and d) means for guiding the paper on track and passed said print head.

4. The system as recited in claim 1, further comprising at least a tape deck and compact disk player.

5. The system as recited in claim 1, wherein the microprocessor is able to convert the information data from a language in which it is transmitted to a language as desired by a user.

* * * * *